United States Patent [19]

Higgins

[11] 4,106,232

[45] Aug. 15, 1978

[54] TOY GLIDER

[76] Inventor: Daniel B. Higgins, 303 Cedar Crook Rd., Naperville, Ill. 60540

[21] Appl. No.: 721,522

[22] Filed: Sep. 8, 1976

[51] Int. Cl.[2] ..... A63H 27/00

[52] U.S. Cl. ..... 46/79; 46/81

[58] Field of Search ..... 46/16, 74, 79, 81

[56] References Cited

U.S. PATENT DOCUMENTS

| | | | |
|---|---|---|---|
| 3,246,425 | 4/1966 | Miller | 46/79 |
| 3,768,198 | 10/1973 | Fields | 46/79 |

*Primary Examiner*—Louis G. Mancene

*Assistant Examiner*—Robert F. Cutting

*Attorney, Agent, or Firm*—Mathew L. Kalinowski

[57] ABSTRACT

A kit for constructing a toy glider from at least one sheet of planar material having parts laid out in a pattern. The parts are cut from the sheet and include a fuselage connected to the front of a pair of superimposed discs, and a pair of tailpieces supporting a simulated horizontal elevator. The discs are spaced along the center of their front and rear edges by upright supports and a tail tube rolled from the sheet material to create an air flow path through the glider during flight to provide lift for sustained flight. The glider is launched by a rubber band connected to a cylindrical dowel.

5 Claims, 3 Drawing Figures

TOY GLIDER

BACKGROUND OF THE INVENTION

This invention relates to a toy glider assembly and construction kit.

Glider toys are designed to superficially resemble powered aircraft or manned sailplanes. Hence they often have relatively massive fuselage portions which reduce the distance and duration of their glides, an the configuration of the craft is such that little, if any, aerodynamic effects can be simulated. Accordingly, they are extremely difficult to catapult into the air, are unrealistic in their flight pattern, and normally come to rest on the ground in an unrealistic manner. Furthermore such toys are usually preassembled, providing no satisfaction in building the toy and seeing it ultimately fly.

SUMMARY OF THE INVENTION

In accordance with the invention, a saucer-type toy glider is constructed from flat cardboard materials containing the parts layed out in a pattern, which are cut from the cardboard. Two oval-shaped discs are superimposed and spaced from each other to enable air during flight to flow therebetween and out a tail tube of rolled cardboard to create an airjoil. Twin tails provide stabilization for the craft resulting in level flight during a glide and an elevator between the tails acts as a rear wing to prevent the glider from dropping down to create a tail heavy attitude. Thus when launched by a rubberband mounted on a dowell, a prolonged and realistic flight pattern is obtained.

BRIEF DESCRIPTION OF THE DRAWING

Further objects and advantages of the invention will become apparent from the following description and claims, and from the accompanying drawing, wherein:

DETAILED DESCRIPTION OF THE PREFERRED EMBODIMENT

Figure 1:
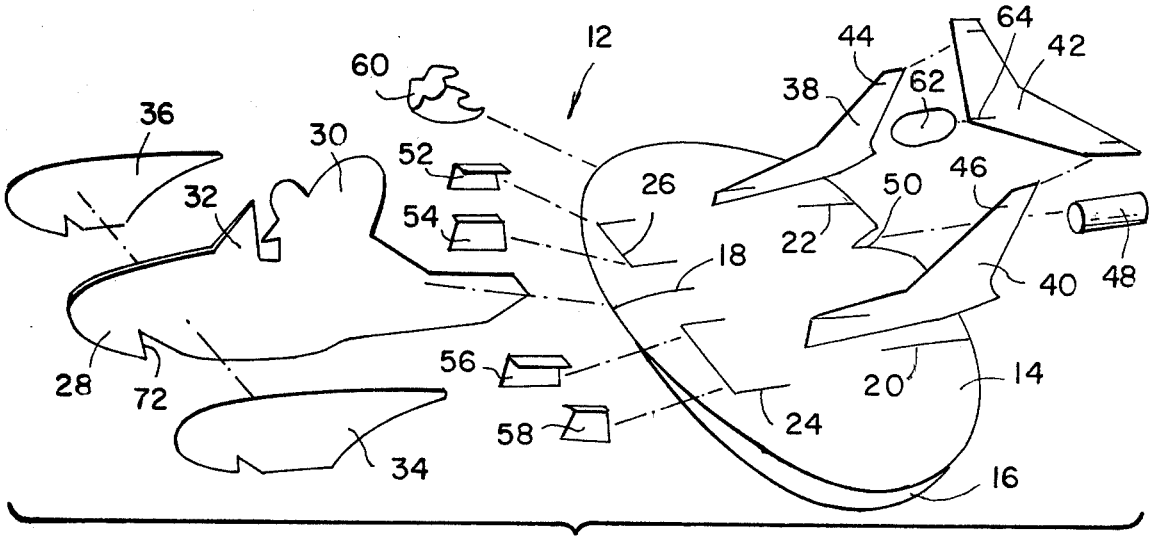
FIG. 1 is an exploded perspective view of the components of the toy glider of the present invention.
Figure 2:
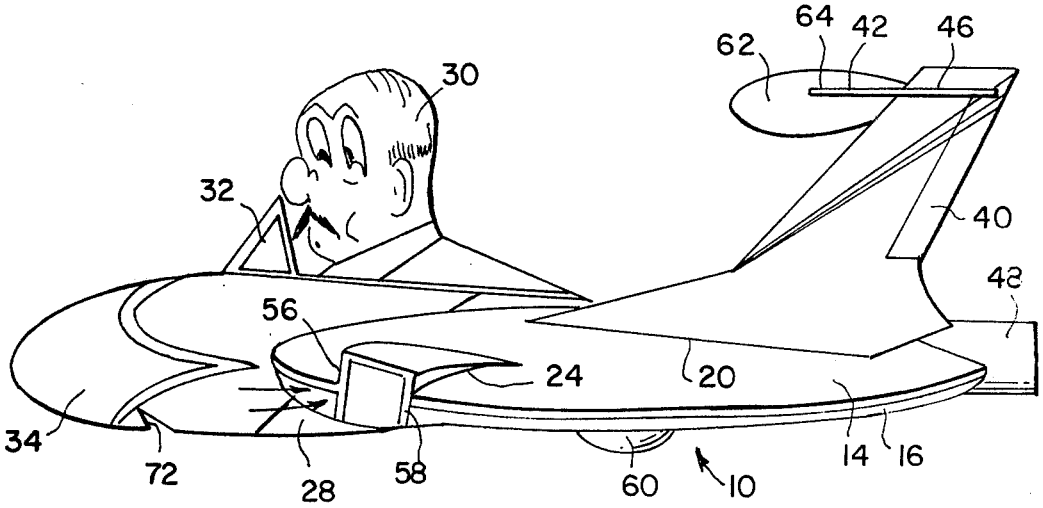
FIG. 2 is a side view in elevation of the assembled toy glider of FIG. 1.
Figure 3:
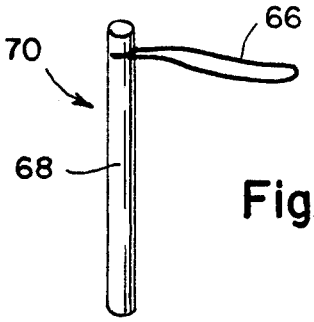
FIG. 3 is a perspective view of a launch device for the toy glider of FIG. 2.

Referring now in detail to the drawing, wherein like numerals indicate like elements throughout the several views, a saucer-type toy glider 10 is assembled from planar cardboard materials containing a plurality of parts 12 layed out in a pattern.

The parts are cut by a scissors from the pattern and assembled with glue as follows:

Step 1. Cut out top and bottom oval-shaped disks 14, 16. Cut slots 18, 20, 22 in superimposed disks 14, 16, as well as three-sided slots 24 and 26.

Step 2. Glue around edge of disks, do not glue space between slots 24 and 26. Superimpose disks 14, 16 so that slot 18 are in line.

Step 3. Cut out fuselage 28 containing a caricature 30 of a pilot behind a cockpit 32.

Step 4. Cut out stiffeners 34, 36 and glue to both sides of fuselage 28.

Step 5. Glue along both sides of the back end of fuselage 28 and insert in slot 18.

Step 6. Cut out tail pieces 38, 40 and insert one into slot 20 and the other in slot 22.

Glue along both sides of 38, 40 at slots 20 and 22.

Step 7. Cut out an elevator 42 and insert into slots 44, 46 cut at top of each tail piece and glue along slot edges.

Step 8. Cut out a flat piece of cardboard and glue the lower third. Roll around to form a tail tube 48. Cut V-shaped slot 50 in disks 14, 16 between tailpieces 38, 40, insert tube 48, and glue edges to disks 14, 16.

Step 9. Cut out planar tabs 52 and 54, 56 and 58. Fold tops at 90 degree angle. Lift up slots 26 and 24, and glue tabs 52 and 54, 56 and 58 in to form two box-like structures between disks 14 and 16, for use as supports in spacing the front of the disks to form an air chamber between the disks.

Step 10. Cut out piece 60 for use as a landing pad, cut slots in bottom disc 16 and glue.

Step 11. Cut oval ornament 62, insert in a slot 64 in center of elevator 42 and glue.

Step 12. Attach a rubber band 66 to a cylindrical wood dowel 68 for use as a launcher 70 for toy glider 10.

Rubber band 66 is inserted in a wedge-shaped slot 72 at the bottom of fuselage 28. The fuselage 28 and disks 14 and 16 are then pulled back against the tension of the rubber band 66 and released. The glider 10 will then be propelled forwardly.

Air during flight will enter the two box-like structures formed by tabs 52, 54 and 56, 58, and will flow through the air chamber between disks 14 and 16, and then through tail tube 48 thereby creating an air foil which will undergo lift in accordance with Bernoulli's principle. The twin tails 38 and 40 provide stabilization for the glider 10 during flight resulting in level flight and elevator 42 acts as a rear wing to prevent the glider from dropping down and creating a tail heavy attitude.

I claim:

1. A kit for assembling a toy glider comprising:

at least one planar sheet of material having a pattern of parts from which said glider is to be assembled, said parts including a pair of oval-shaped discs adapted to be superimposed one above the other and connected along complemental edges except at the front and at the rear center thereof, means adapted to be inserted between said discs at the front thereof to form an air chamber between said discs, means adapted to be inserted between said discs at the rear center thereof to receive air therethrough flowing from said chamber while said glider is in flight, a fuselage adapted to be connected to the front edge of said superimposed discs, and at least one tailpiece adapted to be connected to one of said discs.

2. The kit of claim 1 wherein said means adapted to be inserted between said discs at the front thereof includes upright spacer supports.

3. The kit of claim 1 wherein said means adapted to be inserted between said discs at the rear center thereof includes a tube rolled about itself from a piece of said planar sheet material.

4. The kit of claim 1 including means for launching said glider, said means including a cylindrical dowel, and a rubber band attached to said dowel adapted to be received in a slot in said fuselage.

5. The kit of claim 1 wherein said parts further include:

two upright tailpieces adapted to be connected to the uppermost one of said discs, and a horizontal simulated elevator adapted to be connected between said tailpieces.

* * * * *